US007445134B2

(12) United States Patent
Pardonge

(10) Patent No.: US 7,445,134 B2
(45) Date of Patent: Nov. 4, 2008

(54) FLUID PRODUCT DISPENSING PUMP AND FLUID PRODUCT DISPENSING DEVICE COMPRISING SAME

(75) Inventor: Jean-Marc Pardonge, SaintOuen (FR)

(73) Assignee: Valois S.A.S., Le Neubourg (FR)

( * ) Notice: Subject to any disclaimer, the term of this patent is extended or adjusted under 35 U.S.C. 154(b) by 444 days.

(21) Appl. No.: 10/496,975

(22) PCT Filed: Nov. 25, 2002

(86) PCT No.: PCT/FR02/04036

§ 371 (c)(1),
(2), (4) Date: Feb. 7, 2005

(87) PCT Pub. No.: WO03/045576

PCT Pub. Date: Jun. 5, 2003

(65) Prior Publication Data

US 2006/0011658 A1 Jan. 19, 2006

(30) Foreign Application Priority Data

Nov. 28, 2001 (FR) ..... 01/15378

(51) Int. Cl.
*B67D 88/54* (2006.01)

(52) U.S. Cl. ..... 222/321.7; 222/321.2; 222/321.9

(58) Field of Classification Search ..... 222/321.7, 222/385, 321.9, 321.1, 321.2, 340
See application file for complete search history.

(56) References Cited

U.S. PATENT DOCUMENTS

| | | | | |
|---|---|---|---|---|
| 5,038,965 | A * | 8/1991 | Cater | 222/255 |
| 5,147,073 | A * | 9/1992 | Cater | 222/321.9 |
| 5,163,588 | A * | 11/1992 | Cater | 222/321.2 |
| 5,190,192 | A * | 3/1993 | Lina et al. | 222/321.2 |
| 5,284,276 | A * | 2/1994 | Cater | 222/321.9 |
| 5,566,865 | A * | 10/1996 | Jouillat et al. | 222/287 |
| 5,716,984 | A * | 2/1998 | Cousins et al. | 514/464 |
| 5,772,078 | A | 6/1998 | Knickerbocker | |
| 5,918,778 | A * | 7/1999 | Schultz | 222/321.7 |
| 6,315,169 | B1 * | 11/2001 | de Rosa | 222/321.7 |
| 6,460,738 | B1 * | 10/2002 | Petit | 222/189.09 |
| 6,698,623 | B2 * | 3/2004 | Petit | 222/153.12 |
| 6,811,060 | B2 * | 11/2004 | Petit | 222/321.2 |

FOREIGN PATENT DOCUMENTS

| | | | |
|---|---|---|---|
| EP | 0 718 044 | A | 6/1996 |
| EP | 1 050 481 | A | 11/2000 |
| WO | WO 99 32376 | A | 7/1999 |
| WO | WO 02 32777 | A | 4/2002 |

* cited by examiner

*Primary Examiner*—Frederick C. Nicolas
(74) *Attorney, Agent, or Firm*—Sughrue Mion, PLLC

(57) ABSTRACT

A fluid dispenser pump having a pump body (10) in which at least one piston (15) slides between a rest position and an actuated position, and a turret (20) fixed to the pump body (10). The turret (20) includes an outer portion (21) extending outside the pump body (10) and on the outer portion (21) a support (30) for receiving and holding a sealing gasket (40). The support (30) including a radial shoulder (31), the gasket (40) being snap-fastened onto the shoulder (31).

12 Claims, 2 Drawing Sheets

FLUID PRODUCT DISPENSING PUMP AND FLUID PRODUCT DISPENSING DEVICE COMPRISING SAME

The present invention relates to a fluid dispenser pump and to a fluid dispenser device incorporating such a pump.

Fluid dispenser devices usually comprise a reservoir on which there is mounted a dispenser member, such as a pump. Mounting is performed by means of a fixing element, such as a screw-on or snap-on ring, or a clamping cap. Sealing between the reservoir and the fixing element is achieved by means of a gasket referred to as a "neck gasket". Given that the manufacturer of the pump is generally different from the manufacturer of the fluid to be dispensed, the pump is manufactured, assembled and delivered to the manufacturer of the fluid, who fills the reservoir and then performs the step of fixing said pump onto said reservoir by means of the fixing element. In order to provide the manufacture of fluid with a pump subassembly that is complete and pre-assembled, the pump is generally delivered complete and ready to assemble, i.e. incorporating all the elements essential for its assembly, including the above-mentioned neck gasket. The neck gasket is generally pre-assembled around the pump body so that once the reservoir has been filled, the manufacturer of the fluid need only place the pump on the reservoir neck and assemble it by means of the fixing element. Document EP-1 050 481 describes such a device.

However, a drawback exists in the above-described construction. Pre-assembly of the gasket around the pump body is generally performed by fitting said gasket on the pump body. To facilitate said fitting, the inside peripheral surface of the gasket is generally not annular, but includes several (generally three) contact points in contact with the pump body, which points are evenly distributed around the pump body, and ensure that the gasket is positioned and held once it has been fitted. The gasket therefore exerts a radial force on the pump body, said force being sufficient to prevent said gasket from being displaced during storage or transport. The radial force exerted by the gasket on the outside of the pump body can cause slight deformation of the lateral surface of said pump body which can lead to leakages at the sliding surface of the piston inside the pump body. This is particularly true when the pump is small in size, and when the thickness of the wall of the pump body is therefore thin, thus responding more to the radial compression forces exerted by the gasket. Since the time between the moment when the gasket is pre-assembled around the pump body and the moment when the final device is used can be fairly long, the risks of leakage are not negligible.

Documents EP-0 343 414 and U.S. Pat. No. 5,772,078 disclose pumps in which the piece supporting the pump body, generally referred to as a "turret", includes a radial flange made of relatively soft material and acting as a neck gasket. That configuration implies the use of a specific material for the turret and complicates manufacture.

Document EP-0 825 128 discloses a turret-forming fixing piece, with the neck gasket being integrally molded with said turret. That configuration is complex and implies the use of a complicated and expensive manufacturing machine.

An object of the present invention is to provide a fluid dispenser pump which does not reproduce the above-mentioned drawbacks.

An object of the present invention is therefore to provide a fluid dispenser pump which is simple and inexpensive to manufacture and to assemble, and which is reliable in use.

In particular, an object of the present invention is to provide a fluid dispenser pump which limits the risks of leakage.

The present invention therefore provides a fluid dispenser pump comprising a pump body in which at least one piston slides between a rest position and an actuated position, and a turret fixed to said pump body, said turret including an outer portion extending outside said pump body, said turret including, on said outer portion, support means for receiving and holding a sealing gasket, said support means including a radial shoulder, said gasket being snap-fastened onto said shoulder.

Said turret is advantageously fixed to the top edge of the pump body and includes an inner portion extending inside the pump body and defining the rest position of said at least one piston.

Said gasket is advantageously annular and extends into said support means approximately perpendicularly to the longitudinal central axis of the pump.

Said support means advantageously include an outwardly-extending radial flange, said flange forming a bearing surface for said gasket, and said radial shoulder being axially offset relative to said flange and forming a retaining shoulder for said gasket, said gasket being assembled between said flange and said shoulder.

The outer portion of the turret advantageously includes an axial sleeve that is approximately parallel to the pump body, the top edge of said sleeve being fixed to said pump body, and the bottom edge of said sleeve including said support means.

Said axial sleeve of the turret is advantageously spaced apart from said pump body, so that the gasket does not exert any radial force on said pump body.

The present invention also provides a fluid dispenser device comprising a fluid reservoir and a pump as described above, said pump being mounted on said reservoir by means of a fixing element, such as a fixing ring, said sealing gasket, which is disposed in the support means of the turret, being the gasket that provides sealing between the reservoir and the fixing element.

The gasket is advantageously assembled and retained by the turret of the pump before the pump is assembled on the reservoir.

Said fixing element advantageously co-operates with the radial flange of the turret in order to fix the pump onto the reservoir, with interposition of the gasket.

Other characteristics and advantages of the present invention appear more clearly from the following detailed description of a preferred embodiment thereof, made with reference to the accompanying drawing, and given by way of non-limiting example, in which.

Figure 1:
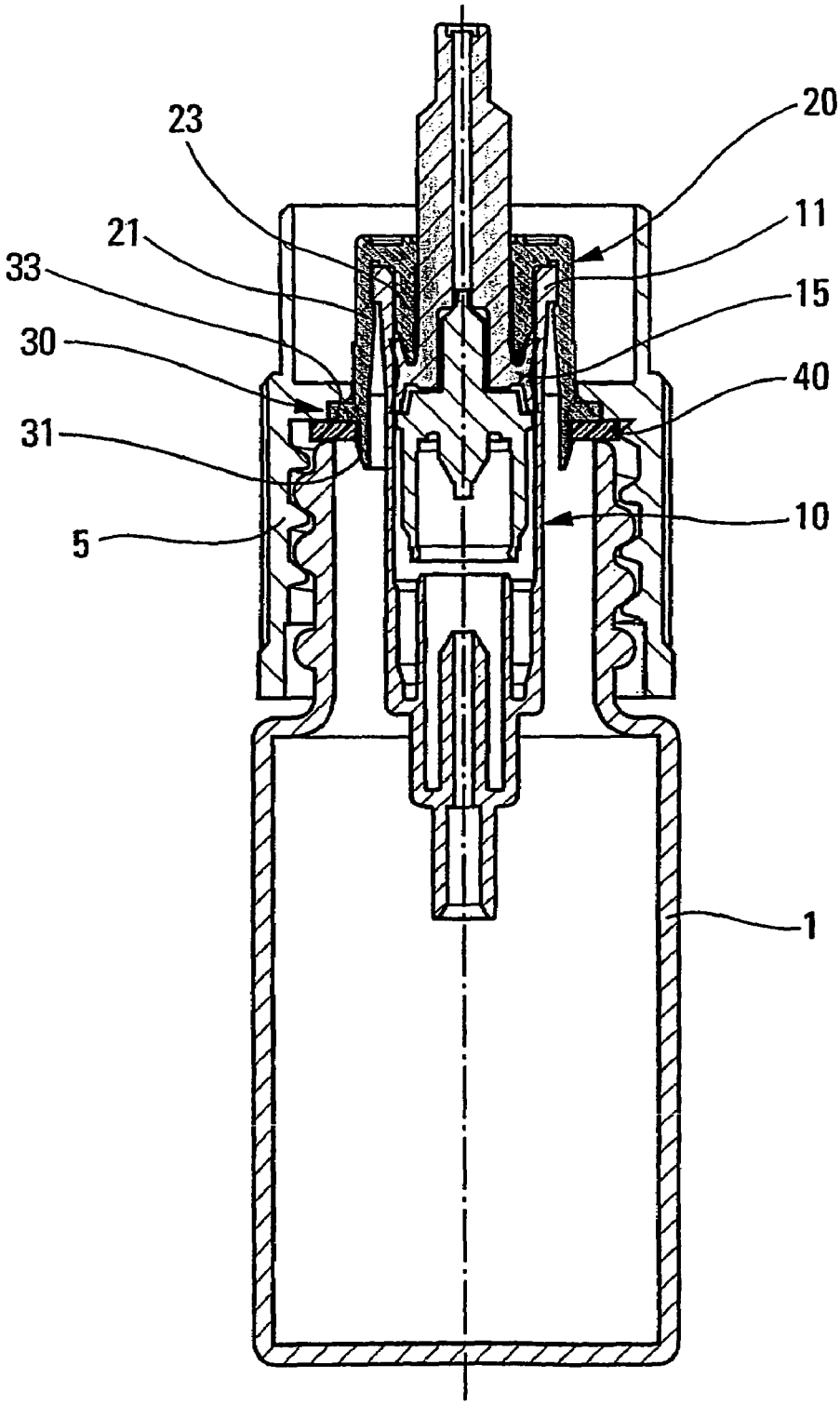
FIG. 1 is a diagrammatic section view of a fluid dispenser device constituting a preferred embodiment of the present invention, after the pump has been assembled on the reservoir.

With reference to FIG. 1, the dispenser pump includes a pump body 10 that is generally cylindrical in shape. At least one piston 15 slides inside the pump body between a rest position, which is shown in FIG. 1, and an actuated position, not shown, in which the piston 15 is displaced inside the pump body. The internal structure of the pump, and its operation, are not described in greater detail below, since the invention does not relate directly to the operation of the pump. On the contrary, the present invention applies to any type of pump, and the pump shown in FIG. 1 is only an example, the scope of the present invention not being limited to said pump.

The pump includes a turret 20 which is fixed to the pump body 10, and more particularly to the top edge 11 of the pump body 10. The turret 20 advantageously includes an inner portion 23 which extends inside the pump body 10 and which can advantageously serve to define the rest position of the piston 15. In the invention, the turret 20 further includes an outer portion 21 which extends outside the pump body and which includes support means 30 for receiving and holding a sealing gasket 40. As shown in FIG. 1, the outer portion 21 is advantageously made in the form of an axial sleeve 21 which extends approximately parallel to the pump body 10, and has a top edge that is fixed to the top edge 11 of the pump body 10, while the bottom edge includes the support means 30. As shown in FIG. 1, the sleeve 21 of the turret 20 is preferably radially spaced apart from the pump body, at least at said support means 30, so that when the gasket 40 is assembled in said support means 30, it does not exert any radial force on the pump body. The present invention thus makes it possible to prevent any deformation of the pump body as a result of the pre-positioning of the neck gasket 40, such that the risk of leakage from the pump is reduced.

The gasket 40 is generally made in the form of an annular disk which extends approximately perpendicularly to the longitudinal central axis of the pump. The gasket 40 is generally intended to provide sealing between the top edge of the neck of a reservoir 1 and a fixing element 5 serving to fix the pump onto said reservoir. The fixing element 5 can be a screw-on ring, as shown in FIG. 1, but could also be made in the form of a snap-on ring or a clamping cap, or more generally in any form that enables the pump to be fixed onto the reservoir.

Figure 2:
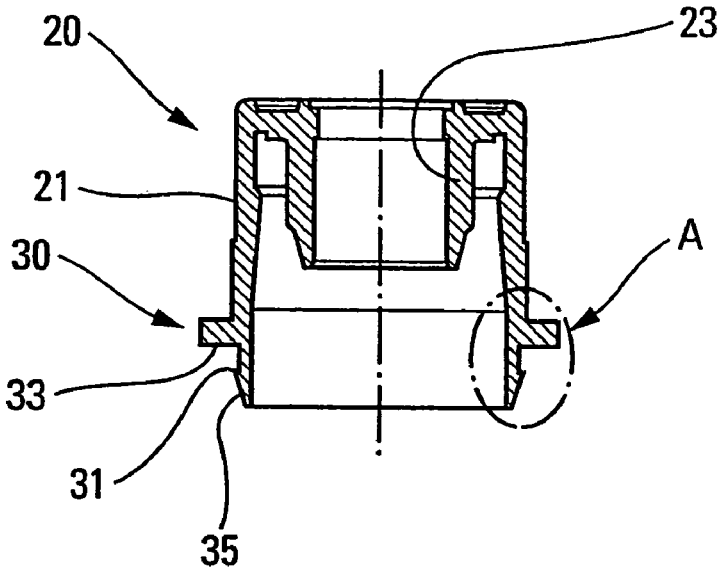
FIG. 2 is a diagrammatic section view of the turret of the pump in FIG. 1.
Figure 3:
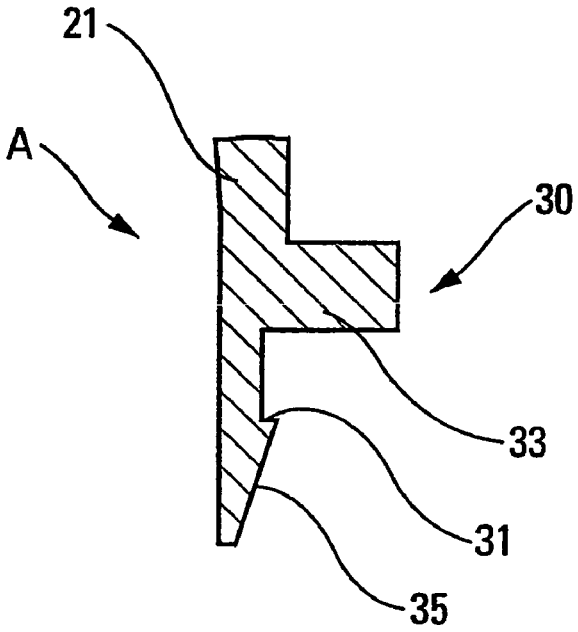
FIG. 3 is a diagrammatic section view on a larger scale of detail A in FIG. 2.

FIGS. 2 and 3 are more-detailed views of the turret 20, and in particular of the support means 30 enabling the gasket 40 to be pre-positioned. The support means advantageously include a radial flange 33 extending outwards, with its top side coming to co-operate with the fixing element 5 while the pump is being fixed on the reservoir. The bottom side of the radial flange 36 forms a bearing surface for the gasket 40. A radial shoulder 31 is also provided, which is axially offset from said radial flange 33, and which forms the retaining shoulder for said gasket 40. The gasket 40 is thus assembled between said radial flange 33 and said radial shoulder 31. An advantage of this method of fixing the gasket 40 resides in the fact that the gasket 40 no longer exerts radial force on the pump body. It can exert such a radial force on the turret, but this causes no risk of leakage from the pump. It is even possible to envisage a gasket 40 that is not necessarily pre-stressed when it is assembled in the support means 30 of the turret. On the contrary, it could be deformed slightly so as to pass over the radial shoulder 31, but it would then snap-fasten between said radial flange 33 and said shoulder 31, and could not, in said position, exert any radial or axial force on the turret. This would make it possible to prevent the gasket deforming during storage or transport of the pump, and more generally before its assembly on the reservoir. In any case, even if the gasket exerts a radial force on the turret, said radial force can be distributed over the entire circumference of the turret, contrary to the prior art, in which the gasket is held on the pump body at three points and therefore exerts said radial force at three points only, thereby causing a risk of the gasket deforming. The present invention eliminates this risk by distributing the radial force, if any, over the entire circumference. To facilitate putting the gasket in place, the shoulder 31 can be extended by a sloping ramp 35 which facilitates putting in place, assembling, or more generally snap-fastening the gasket 40 in said support means of the turret 20.

Thus, the manufacturer of the pump assembles all the component elements of the pump inside the pump body, fixes the turret 20 on the pump body, and then pre-assembles the gasket 40 in the support means 30 of the turret 20. The sub-assembly is then delivered to the manufacturer of the fluid, who then fills the reservoir 1 with the fluid, and then places the pump on the neck of the reservoir, the gasket 40 generally being disposed on the top edge of said reservoir. The pump is then fixed by the fixing element 5, which in the FIG. 1 assembly is a screw-on ring. The present invention therefore makes it possible to obtain in simple and inexpensive manner the same advantages as with existing pumps, namely the manufacturer of the fluid receiving a complete pump unit which it suffices to assemble once the reservoir has been filled, without the above-mentioned drawbacks, namely the risk of leakage from the pump body as a result of the compression forces exerted by the gasket fitted around the pump body.

Although the invention is described above with reference to a particular embodiment thereof, naturally, the invention is not limited to that particular embodiment, and, on the contrary, the person skilled in the art can apply any modifications thereto, without going beyond the ambit of the present invention as defined by the accompanying claims.

The invention claimed is:

1. A fluid dispenser pump comprising a pump body (10) in which at least one piston (15) slides between a rest position and an actuated position, and a turret (20) fixed to said pump body (10) and defining the rest position of said at least one piston (15), said turret (20) including an outer portion (21) extending outside said pump body (10), said turret (20) including, on said outer portion (21), support means (30) for receiving and holding a sealing gasket (40), said gasket (40) being annular and extending into said support means (30) approximately perpendicularly to a longitudinal central axis of the pump, the pump being characterized in that said support means (30) include a radial shoulder (31) extending outwards, said gasket (40) being snap-fastened onto said shoulder (31); and wherein the turret (20) is fixed to a top edge (11) of the pump body (10) and includes an inner portion (23) extending inside the pump body (10) and wherein said support means include an outwardly-extending radial flange, said flange forming a bearing surface for said gasket, said radial shoulder being axially offset relative to said flange and forming a retaining shoulder for said gasket, said gasket being assembled between said flange and said shoulder.

2. A pump according to claim 1, in which said outer portion (21) of said turret (20) is radially spaced apart from said pump body (10) at said support means (30), so that the gasket (40) does not exert any radial force on said pump body (10).

3. A fluid dispenser pump comprising a pump body in which at least one piston slides between a rest position and an actuated position, and a turret fixed to said pump body and defining the rest position of said at least one piston, said turret including an outer portion extending outside said pump body, said turret including, on said outer portion, support means for receiving and holding a sealing gasket, said gasket being annular and extending into said support means approximately perpendicularly to the longitudinal central axis of the pump, the pump being characterized in that said support means include a radial shoulder extending outwards, said gasket being snap-fastened onto said shoulder; and wherein the turret is fixed to the top edge of the pump body and includes an inner portion extending inside the pump body and wherein the outer portion (21) of the turret (20) includes an axial sleeve (21) that is approximately parallel to the pump body (10), the top edge of said sleeve (21) being fixed to said pump body (10), and a bottom edge of said sleeve (21) including said support means (30).

4. A pump according to claim 3, in which said axial sleeve (21) of the turret (20) is spaced apart from said pump body (10), so that the gasket (40) does not exert any radial force on said pump body (10).

5. A fluid dispenser device comprising:

a pump comprising a pump body in which at least one piston slides between a rest position and an actuated position, and a turret fixed to said pump body and defining the rest position of said at least one piston, said turret including an outer portion extending outside said pump body, said turret including, on said outer portion, support means for receiving and holding a sealing gasket, said gasket being annular and extending into said support means approximately perpendicularly to the longitudinal central axis of the pump, the pump being characterized in that said support means include a radial shoulder extending outwards, said gasket being snap-fastened onto said shoulder; and a fluid reservoir; and wherein the turret is fixed to the top edge of the pump body and includes an inner portion extending inside the pump body and wherein the pump is mounted on said reservoir (1) by means of a fixing element (5), said sealing gasket (40), which is disposed in the support means (30) of the turret (20), being the gasket that provides sealing between the reservoir (1) and the fixing element (5).

6. A device according to claim 5, in which the gasket (40) is assembled and retained by the turret (20) of the pump before the pump is assembled on the reservoir (10).

7. A device according to claim 5, in which said fixing element (5) co-operates with a radial flange (33) of the turret (20) in order to fix the pump onto the reservoir (1), with interposition of the gasket (40).

8. The fluid dispenser device according to claim 5, wherein the fixing element is a fixing ring.

9. A fluid dispenser pump comprising a pump body in which at least one piston slides between a rest position and an actuated position, and a turret fixed to said pump body and defining the rest position of said at least one piston, said turret including an outer portion extending outside said pump body, said turret including, on said outer portion, a support that receives and holds a sealing gasket, said gasket being annular and extending into said support flange approximately perpendicularly to a longitudinal central axis of the pump; and wherein the support includes a radial shoulder extending outwards, said gasket being snap-fastened onto said shoulder; and wherein the turret is fixed to a top edge of the pump body and includes an inner portion extending inside the pump body; and wherein said support include an outwardly-extending radial flange, said flange forming a bearing surface for said gasket, said radial shoulder being axially offset relative to said flange and forming a retaining shoulder for said gasket, said gasket being assembled between said flange and said shoulder.

10. The pump according to claim 9, wherein the outer portion of said turret is radially spaced apart from said pump body at said support, so that the gasket does not exert any radial force on said pump body.

11. A fluid dispenser pump comprising a pump body in which at least one piston slides between a rest position and an actuated position, and a turret fixed to said pump body and defining the rest position of said at least one piston, said turret including an outer portion extending outside said pump body, said turret including, on said outer portion, a support that receives and holds a sealing gasket, said gasket being annular and extending into said support flange approximately perpendicularly to the longitudinal central axis of the pump; and wherein the support includes a radial shoulder extending outwards, said gasket being snap-fastened onto said shoulder; and wherein the turret is fixed to the top edge of the pump body and includes an inner portion extending inside the pump body; and wherein the outer portion of the turret includes an axial sleeve that is approximately parallel to the pump body, the top edge of said sleeve being fixed to said pump body, and the bottom edge of said sleeve including said support.

12. A fluid dispenser device comprising:

a fluid reservoir; and a pump, the pump comprising a pump body in which at least one piston slides between a rest position and an actuated position, and a turret fixed to said pump body and defining the rest position of said at least one piston, said turret including an outer portion extending outside said pump body, said turret including, on said outer portion, a support that receives and holds a sealing gasket, said gasket being annular and extending into said support flange approximately perpendicularly to a longitudinal central axis of the pump; and wherein the support includes a radial shoulder extending outwards, said gasket being snap-fastened onto said shoulder;

wherein the turret is fixed to a top edge of a pump body and includes an inner portion extending inside the pump body;

wherein said pump is mounted on said reservoir by a fixing ring; and wherein said sealing gasket, which is disposed in the support of the turret (20), provides sealing between the reservoir and the fixing ring.

* * * * *